US005545431A

United States Patent [19]

Singh et al.

[11] Patent Number: 5,545,431

[45] Date of Patent: Aug. 13, 1996

[54] METHOD FOR MAKING A ROTARY SEAL MEMBRANE

[75] Inventors: Jogender Singh, Westchester; Jerry D. Schell; William R. Young, both of Cincinnati, all of Ohio

[73] Assignee: General Electric Company, Cincinnati, Ohio

[21] Appl. No.: 473,389

[22] Filed: Jun. 7, 1995

Related U.S. Application Data

[62] Division of Ser. No. 685,110, Apr. 15, 1991, Pat. No. 5,484,665.

[51] Int. Cl.[6] ..... B05D 3/00; B05D 5/00

[52] U.S. Cl. ..... 427/205; 427/287; 427/376.8; 427/383.7

[58] Field of Search ..... 427/205, 217, 427/455, 202, 376.8, 287, 383.7; 277/53; 416/235 R, 241 R, 241 B; 148/242, 269, 513; 428/552, 561, 661, 662

[56] References Cited

U.S. PATENT DOCUMENTS

| | | | |
|---|---|---|---|
| Re. 31,883 | 5/1985 | Bovenkerk et al. | 51/295 |
| 2,798,843 | 7/1957 | Slomin et al. | 204/32 |
| 3,297,552 | 1/1967 | Gisser et al. | 204/37 |
| 3,309,292 | 3/1967 | Andrews et al. | 204/39 |
| 3,339,933 | 9/1967 | Foster | 277/53 |
| 3,723,165 | 3/1973 | Longo et al. | 117/93.1 PF |
| 4,137,370 | 1/1979 | Fujishiro et al. | 428/660 |
| 4,169,020 | 9/1979 | Stalker et al. | 204/16 |
| 4,227,703 | 10/1980 | Stalker et al. | 277/53 |
| 4,232,995 | 11/1980 | Stalker et al. | 415/172 A |
| 4,249,913 | 2/1981 | Johnson et al. | 51/295 |
| 4,305,998 | 12/1981 | Mauty et al. | 428/661 |
| 4,608,128 | 8/1986 | Farmer et al. | 204/16 |
| 4,730,093 | 3/1988 | Mehta et al. | 219/121 LC |
| 4,743,733 | 5/1988 | Mehta et al. | 219/121 LF |
| 4,744,725 | 5/1988 | Matarese et al. | 415/172 A |
| 4,745,254 | 5/1988 | Funk | 219/76.15 |
| 4,761,346 | 8/1988 | Naik | 428/627 |
| 4,770,907 | 9/1988 | Kimura | 427/217 |
| 4,808,855 | 2/1989 | Wertz et al. | 416/224 |
| 4,839,237 | 6/1989 | Conlon et al. | 428/610 |

FOREIGN PATENT DOCUMENTS

| | | |
|---|---|---|
| 0034408 | 8/1981 | European Pat. Off. . |
| 0166676 | 2/1986 | European Pat. Off. . |
| 0246828 | 11/1987 | European Pat. Off. . |
| 0282831 | 9/1988 | European Pat. Off. . |
| 1-100302 | 4/1989 | Japan . |
| 675179 | 7/1952 | United Kingdom . |
| 681250 | 10/1952 | United Kingdom . |

OTHER PUBLICATIONS

The Science, Technology and Application of Titanium, TN 799.T5, 1970 pp. 939.

Handbook of Chemistry & Physics, QD65.C4, 57th edition 1976–1977 pp. D171–D172.

Wpil/derwent, Abstract nr 81–3100d c18; JP 560267634. No date.

Journal of Metals, Production of Rapidly Solidified Metals & Alloys, vol. 36, No. 4, Apr. 1984, pp. 20–23.

"Cold Forming", Huntington Alloys, 1967, p. 7. (No Month).

*Primary Examiner*—Shrive Beck
*Assistant Examiner*—Fred J. Parker
*Attorney, Agent, or Firm*—Andrew C. Hess; David L. Narciso

[57] ABSTRACT

A rotary seal member, such as a gas turbine engine blade, is provided with an improved surface layer which has an elastic modulus matched with the elastic modulus of a substrate of the member. Also, the surface layer does not form a brittle intermetallic with the substrate at an intended operating temperature. In one form, the surface layer includes abrasive particles adapted to inhibit chemical reaction with the layer material. One specific example is a Ti-alloy substrate having a metallurgically bonded layer based on Nb, and including cubic boron nitride abrasive particles coated with cobalt entrapped in the layer.

9 Claims, No Drawings

METHOD FOR MAKING A ROTARY SEAL MEMBRANE

This application is a division of application Ser. No. 07/685,110, filed Apr. 15, 1991, now U.S. Pat. No. 5,484, 665.

This invention relates to rotary seal members including abrasive particles, and, more particularly, to a method for making a surface portion of such member and the member made thereby.

BACKGROUND OF THE INVENTION

The efficiency of gas turbine engines is dependent, in part, on the ability of engine components to confine the motive fluids, such as air and products of combustion, to intended pathways. Leakage from such design flowpaths can reduce efficiency. Accordingly, designers of gas turbine engines have reported a variety of sealing arrangements to reduce or control such leakage. One type of arrangement includes closely spaced, juxtaposed rotary seal members, one surface of which is harder than, or more abrasive to, the opposing member surface. Upon relative thermal expansion of such surfaces, tending to close the space between them into an abrasive or galling condition, the harder surface will remove a portion of the opposing surface to approach a "zero clearance" condition. Sometimes the abrading surface includes embedded abrasive particles.

One example of such a sealing arrangement is at the tip portion of a blading member, rotating relative to an opposing shroud. Some gas turbine engine compressors have used titanium alloy blading members which, as a result of rubbing on a shroud, have produced titanium alloy ignition from heat generated by friction. Therefore, it is important, in such an arrangement, to provide appropriate abrasion to control clearance yet dissipate friction heat to a point below the ignition point of the member surface portions of such a seal. Also, it is important to retain abrasive particles, when used, upon the surface of the abrading member by a means which is metallurgically and thermally stable to enhance integrity of the arrangement.

SUMMARY OF THE INVENTION

The present invention, in one form, provides a substrate of a member of a rotary seal with an improved surface portion by metallurgically bonding to the substrate a layer of specifically selected characteristics: the layer is characterized by having an elastic modulus matched with that of the substrate; preferably it has good oxidation resistance for high temperature operating conditions; and the layer has a solid solubility with the substrate such that brittle intermetallics are not formed between them at the operating temperature.

In the form in which abrasive particles are included, there is applied to the abrasive particles a metallic coating which resists reaction with the layer on the substrate. The layer is melted to generate a molten pool into which the coated abrasive particles are deposited.

When abrasive particles are used in the rotary seal, the deposition of the abrasive particles can be accomplished in two fashions. When the particles have significantly higher specific gravity than the molten pool, the particles may be deposited directly into the pool while still molten. The particles will sink and become entrapped as the pool solidifies. For particles having about the same specific gravity or a lower specific gravity than the molten pool, particles are injected into the pool and entrapped in the pool by solidification before the particles rise to the surface. One method for accomplishing this is by controlling the solidification rate. One example for controlling the solidification rate is by directing suitable carrier gas stream at the molten pool. This carrier gas provides velocity to the particles and assists in removing heat from the solidifying pool.

The article of the present invention is a member of a rotary seal having a substrate to which is metallurgically bonded a layer of the above described characteristics. In one form, the layer has entrapped therein the above described coated abrasive particles.

DESCRIPTION OF THE PREFERRED EMBODIMENTS

During the evaluation of titanium alloy gas turbine engine compressor blades, of the commercially available Ti-6Al-4V alloy, to the tips of which had been applied abrasive particles, for example, by nickel plating entrapment, a loss of resistance to high cycle fatigue (HCF) was observed, for example, by at least about 50% in some cases. The abrasive particles selected for this extensive evaluation were carbides, $Al_2O_3$ and cubic boron nitride (CBN) applied to the blade tip through bond coats primarily based on Ni or Cu. Included in this evaluation were blade tips which were uncoated, coated with various layers without abrasive particles applied in various state-of-the-art methods, and bond coats into which were disposed the abrasive particles. The effect of subsequent heat treatment also was evaluated. It was concluded from this evaluation that loss of HCF strength was based primarily on the physical and metallurgical relationship between the substrate titanium alloy and the bonding layer into which the abrasive particles can be disposed, if desired for a particular application. More specifically, it was recognized that the elastic modulus of the bonding layer be matched with that of the substrate. Herein, the above term "matched" in respect to elastic modulii is intended to mean that the differential between them is insufficient to cause stresses at the interface great enough to initiate cracking at the interface.

In addition, it was observed that some bond layers have a solid solubility with the substrate, at least at the intended operating temperature of the article, which generates brittle intermetallics, for example as observed on an appropriate phase diagram. Therefore, another aspect of the present invention is the selection of a bonding layer which does not form such brittle intermetallics.

The present invention combines the critical features of providing, on a substrate, a layer which has an elastic modulus matched with that of the substrate and which will not form brittle intermetallics with the substrate. Further, for application in strenuous oxidizing environments, such as are found in portions of gas turbine engines, the layer is characterized by good oxidation resistance. Such a layer, if harder than an opposing rotary seal surface, can be used alone. However, frequently it is more desirable to entrap abrasive particles within the layer.

In one example of the present invention, tips of a series of gas turbine engine compressor blades of the above mentioned, commercially available Ti-6Al-4V alloy were prepared. The modulus of elasticity of such titanium alloy is low, about $16\times10^6$ psi. To match such a modulus of elasticity, a layer of Nb was applied to a thickness of at least about 0.002" preferably between about 0.002–0.03, and predominantly in the range of about 0.010–0.030", to enable subsequent abrasive particle disposition. Nb was selected as one preferred form of the present invention because its elastic modulus of about $15\times10^6$ psi is matched with that of the titanium alloy substrate. Also, it does not form brittle intermetallics, as observed from the relative solid solubility on a phase diagram between Ti and Nb, and it has good oxidation resistance at the intended operating temperature, for example from about 500° F. to about 1400° F.

After cleaning a machined Ti-alloy blade tip, the Nb layer was applied using −60 mesh Nb powder and a 5 KW CW $CO_2$ laser beam operated at 2–3 KW in argon gas by the method known commercially as laser cladding. This provided both a metallurgical bond between the Nb layer and the Ti-alloy substrate and a good interface between such portions. One form of such a method is described in U.S. Pat. No. 4,743,733—Mehta et al, patented May 10, 1988, the disclosure of which is hereby incorporated herein by reference.

This combination of substrate and bonded layer showed only about a 25% HCF reduction, rather than a 50% HCF reduction with other combinations, as compared with a base line HCF strength for bare Ti-6Al-4V alloy. Testing was conducted primarily at room temperature, with some testing in the evaluation conducted at 700° F.

In other evaluations, an Ag-base brazing alloy was substituted for Nb as the layer on the substrate because its elastic modulus of about 10 to $14\times10^6$ psi is matched with that of the Ti-alloy substrate. Also, it does not form brittle intermetallics with Ti, as applied. The Ag alloy was applied by laser plasma. Room temperature HCF testing showed the same favorable HCF strength as with Nb. Although for certain high temperature applications, Ag alloys do not have the desired oxidation resistance, they can be used according to the present invention where its oxidation resistance is acceptable under intended operating conditions.

As was mentioned above, one of the important features of the present invention is that the layer disposed on the substrate have an elastic modulus matched with that of the substrate. Metals having values of elastic modulus between about $10\times10^6$ psi to about $20\times10^6$ psi are typically suitable. In addition to the Nb or Ag-alloy based systems described above, such elements as Zr, Hf, Au, Pd, V and Cu and other elements and their combinations having an elastic modulus matching that of the substrate could also be used.

In one example in which abrasive particles were entrapped within the layer disposed on the substrate, abrasive particles in the size range of about 100–120 microns of cubic boron nitride (CBN) were used. Such particles are commercially available as Borazon abrasive particles. In one form of the present invention, there was applied to the particles a coating which resists reaction with the layer on the substrate, for example it has poor solubility with such layer and does not dissolve detrimentally therein. In this example, the CBN particles were coated with Co by the commercially available chemical vapor deposition (CVD) method to a thickness which increased the weight of the particles by about 50 wt %.

After a Ti-6Al-4V alloy compressor blade was prepared with a Nb layer as described above, the Nb layer was remelted with a $CO_2$ laser to form a molten pool region on the blade tip. The Co-coated CBN particles were deposited into the molten pool, for example by the method described in the above incorporated U.S. Pat. No. 4,743,733—Mehta, et al. In another example, the Nb was first melted on the Ti-alloy substrate and the abrasive particles were deposited in that molten pool downstream of the laser beam.

The CBN particles, having a lower specific gravity than the molten Nb pool, were injected by an inert gas stream having a sufficient velocity to cause the immersion of the particles in the molten pool to a controlled depth before solidification. Rapid solidification then caused the particles to become entrapped.

In one embodiment there was provided a titanium alloy compressor blade including a tip portion with Co-coated CBN abrasive particles entrapped by a Nb layer which was bonded to the titanium alloy substrate. Such a blade is characterized by having a stable, oxidation resistant abrasive blade tip. Importantly, the tip has thermal characteristics providing good heat dissipation and resistance to the initiation of ignition of the titanium alloy substrate resulting from rubbing in a rotary seal interference condition. CBN abrasive particles, as well as diamonds, are specifically preferred in this relationship because they generate less heat than other abrasive particles, such as $Al_2O_3$ and carbides of Si, W and B. In addition, CBN and diamonds have superior cutting ability.

To demonstrate the unexpected advantages of the combination of the present invention (matched elastic modulii and no detrimental intermetallics in respect to the substrate layer and coated abrasive particles, as described above), uncoated CBN particles were applied to the prepared blade tip of a Ti-6Al-4V alloy blade. Application was accomplished by nickel entrapment electrodeposition, for example as described in U.S. Pat. No. 4,608,128—Farmer, et al, patented Aug. 26, 1986, the disclosure of which is hereby incorporated herein by reference. Standard room temperature HCF tests showed blade strength HCF losses of about 50% compared with bare shot peened blade tips. Similar tests on the combination of the present invention showed half of such losses.

Photomicrographic studies of the Nb layer on the Ti-alloy substrate showed the Nb to be metallurgically bonded with the substrate. The concentration of the Nb decreased as it approached the substrate showing a graded layer including Ti and small fractions of Al and V. Optical photographs showed no disintegration of the coated CBN particles and no chemical reaction between the particles and the matrix layer of Nb. The particles were well distributed inside the melt pool region.

Parallel testing using $Al_2O_3$ particles instead of CBN showed a severe reaction zone between the $Al_2O_3$ abrasive particles and the melted Nb. This emphasizes one feature of that form of the present invention of either selecting particles which do not react chemically with the layer, or coating the particles with a material which inhibits such reaction. In this way, other abrasive particles such as oxides, carbides and nitrides could be used in selected application according to the combination of the present invention if they are adapted to inhibit chemical reaction.

Although this invention has been described in connection with specific examples and embodiments, they have been presented as typical rather than limitations on the present invention. The appended claims are intended to cover a variety of arrangements embodying the combination of the present invention.

We claim:

1. A method for providing a metallic substrate for a member of a rotary seal with an improved metallic surface layer, the substrate having a first elastic modulus, comprising the steps of:

selecting a metallic layer material which has:

i) a second elastic modulus matched with the first elastic modulus, and ii) a solid solubility with the substrate which does not form with the substrate at any time including as-applied as well as at an intended operating temperature in the range of about 500°–1400° F. an intermetallic, as defined by a relative solid solubility and phase relationship between the metallic layer material and the metallic substrate, and which is sufficiently brittle to result in loss of resistance to high cycle fatigue of the metallic substrate at room temperature of greater than about 25% as compared with a base line high cycle fatigue strength for bare substrate; and metallurgically bonding the metallic layer material directly to the substrate.

2. The method of claim 1 in which the layer is based on an element selected from the group consisting of Nb, Zr, Hf and V.

3. The method of claim 1 in which the layer is based on an element selected from the group consisting of Au, Pd, Ag and Cu.

4. The method of claim 1 in which:

the substrate is an alloy based on titanium; and the layer is based on Nb.

5. A method of providing a metallic substrate of a member of a rotary seal with an improved metallic surface layer including abrasive particles, the substrate having a first elastic modulus, comprising the steps of:

selecting a metallic layer material which has:

i) a second elastic modulus matched with the first elastic modulus, and ii) a solid solubility with the substrate which does not form with the substrate at any time including as-applied as well as at an intended operating temperature in the range of about 500°–1400° F. an intermetallic, as defined by a relative solid solubility and phase relationship between the metallic layer material and the metallic substrate, and which is sufficiently brittle to result in loss of resistance to high cycle fatigue of the metallic substrate at room temperature of greater than about 25% as compared with a base line high cycle fatigue strength for bare metallic substrate;

selecting abrasive particles which resist chemical reaction with the layer material;

melting the layer to generate a molten metallic pool directly on the substrate;

depositing the abrasive particles in the molten pool; and then allowing the molten pool to solidify about the abrasive particles to bond the layer material directly to the substrate.

6. The method of claim 5 in which the layer is based on an element selected from the group consisting of Nb, V, Zr, and Hf.

7. The method of claim 5 in which the layer is based on an element selected from the group consisting of Au, Pd, Cu and Ag.

8. The method of claim 5 in which:

the substrate is an alloy based on Ti;

the layer is based on Nb; and the abrasive particles are cubic boron nitride coated with Co.

9. The method of claim 5 in which:

the abrasive particles have a particle specific gravity;

the molten pool has a pool specific gravity of at least about the particle specific gravity;

the particles are deposited by injecting the particles into the pool with a carrier gas; and the molten pool solidification rate is controlled while the particles are deposited in the pool by directing the carrier gas at the molten pool at a rate which removes heat from and promotes solidification of the molten pool to inhibit rising of the particles to the pool surface during pool solidification.

* * * * *